United States Patent [19]

Anderson et al.

[11] 4,342,035

[45] Jul. 27, 1982

[54] FREQUENCY COMPENSATING REFLECTOR ANTENNA

[75] Inventors: Iain Anderson; Ralph Benjamin; Thomas R. Morgan, all of Cheltenham, England

[73] Assignee: The Secretary of State for Defence in Her Britannic Majesty's Government of the United Kingdom of Great Britain and Northern Ireland, London, England

[21] Appl. No.: 83,917

[22] Filed: Oct. 11, 1979

[30] Foreign Application Priority Data

Jul. 33, 1979 [GB] United Kingdom ..... 7925563

[51] Int. Cl.[3] ..... H01Q 11/10

[52] U.S. Cl. ..... 343/792.5; 343/755

[58] Field of Search ..... 343/792.5, 756, 909, 343/840, 781 P, 781 CA, 753, 755

[56] References Cited

U.S. PATENT DOCUMENTS

| | | | |
|---|---|---|---|
| 2,790,169 | 4/1957 | Sichak | 343/756 |
| 3,148,370 | 9/1964 | Bowman | 343/909 |
| 3,277,490 | 10/1966 | Williams | 343/792.5 |
| 3,394,378 | 7/1968 | Williams et al. | 343/779 |
| 3,649,934 | 3/1972 | Matthaei et al. | 343/756 |
| 3,763,493 | 10/1973 | Shimada et al. | 343/840 |
| 4,198,639 | 4/1980 | Killion | 343/792.5 |

FOREIGN PATENT DOCUMENTS

| | | |
|---|---|---|
| 49-1370669 | 10/1974 | Japan . |
| 1004049 | 9/1965 | United Kingdom . |

*Primary Examiner*—David K. Moore

*Attorney, Agent, or Firm*—Pollock, VandeSande & Priddy

[57] ABSTRACT

A reflector antenna comprising a reflector system, and a feed system, for instance a log-periodic feed system, the phase center of which moves with frequency, for illuminating the reflector system to produce a substantially focussed antenna beam. To compensate for frequency variations in the position of the phase-center of the feed system, the reflector system includes a frequency dependent reflector the effective surface of reflection of which varies with frequency to cause the focus of the reflector system to move with the phase-center of the feed system. A number of different forms of suitable frequency dependent reflectors are described, employing composite arrangements frequency selective mesh or grid reflector elements, or arrays of reflecting horns or wedges.

16 Claims, 7 Drawing Figures

FREQUENCY COMPENSATING REFLECTOR ANTENNA

This invention relates to reflector antennae, and in particular to broadband reflector antennae employing feed systems the phase-centers of which vary in position with frequency.

The log-periodic feed, ie one having a structural geometry such that its electrical characteristics repeat periodically as the logarithm of the operating frequency, is particularly suitable for use in reflector antennae because it is capable of producing a substantially constant beam angle over several octaves of bandwidth. A disadvantage of the log-periodic feed in such applications is that the position of its phase center, ie its effective radiating point, varies axially with frequency. In the case of reflector antennae having a well defined focus, this phase center movement causes undesirable defocusing of the antenna beam, the degree of which depends on frequency, and on the focal length and aperture of the reflector system.

It is an object of the present invention to provide means whereby the above-mentioned disadvantage can be overcome or at least substantially reduced.

According to the present invention, in a reflector antenna comprising a reflector system, and a feed system the phase-center of which varies in position with frequency, for illuminating the reflector system to produce a substantially substantially focused antenna beam, the reflector system comprises a frequency dependent reflector the effective surface of reflection of which varies with frequency in such a way as to cause the position of the focus of the reflector system to vary with, and thereby substantially compensate for variations in, the position of the phase center of the feed system with frequency.

There are a number of ways in which the effective surface of reflection of the frequency dependent reflector, defined at any given frequency as that surface in space which would be occupied by an ideal reflecting surface to produce substantially the same effect, may be made to vary in accordance with the invention.

For example, simple axial movement of the effective reflecting surface of the frequency dependent reflector with frequency, towards and away from the feed system can be made to produce the desired variation in the position of the focus of the reflecting system. No physical movement of the reflector is necessary. In the case of a reflector system consisting of only one reflector, this will of course provide the frequency dependent reflector. Where the reflector system comprises two (or more) reflectors, for example a sub-reflector arranged to reflect radiation between the log-periodic feed system and a main reflector, the frequency dependent reflector may be provided either by the main reflector or by the sub-reflector. In this latter case, the sub-reflector can advantageously be made relatively small, and because of its two-way effect on path length, requires a much smaller variation in the position of its effective reflecting surface than would otherwise be required. Alternatively, multiple reflections between a pair of sub-reflectors, at least one of which is frequency dependent, can be used to provide the required variation in the position of the focus, enabling a further reduction in the required movement of the effective reflecting surface or surfaces with frequency. A preferred form of frequency dependent reflector of this kind comprises a plurality of substantially parallel frequency selective reflector elements each arranged to reflect incident radiation in a predetermined frequency range and to transmit incident radiation above this range, different reflector elements having different predetermined frequency ranges, and the elements being spaced apart from the feed system along the incident beam path in order of increasing frequency of reflection. The frequency selective reflector elements preferably each comprise a suitably contoured (or planar, where appropriate) conducting pattern which comprises, or represents in terms of its electric characteristics, a set of substantially parallel conducting strips, or two or more such sets of strips superimposed in any desired relative orientations, the spacing and width of these strips in any given orientation representing the pitch and gauge of the pattern respectively in that orientation. The rearmost reflector element may conveniently comprise a continuous conducting surface.

The terms pitch and mesh gauge used hereinafter will refer to these parameters.

The reflector elements may be of any suitable form having the desired frequency dependent characteristics. For example the reflector elements may comprise woven wire meshes having eg square or hexagonal (chicken-wire) interstices of appropriate dimensions, or may comprise a conducting metallic pattern formed by deposition, followed where necessary by etching. It should be noted that the symmetry of polarization of the reflected radiation depends on the dimensions of the interstices in the appropriate orientation. A reflector comprising simply an array of spaced parallel wires or conducting strips will not reflect radiation polarized in an orientation perpendicular to the conducting strips. The frequency selective properties of, eg inductive mesh reflector elements depend on the mesh pitch. The coarser meshes, ie having larger mesh pitch, are generally transparent to radiation at shorter wavelengths, as is well understood in the art, while the finest pitch meshes are generally capable of reflecting all but the highest frequencies. The proportion of radiation transmitted at any frequency is also dependent on the mesh gauge, ie the width of conductor between the interstices of the mesh. Preferably the pitches and axial spacings of the reflector elements of the frequency dependent reflector correspond to the lengths and axial spacings of respective elements of a log-periodic feed system to provide a substantially matching log-periodic reflector assembly. Where the frequency dependent reflector is provided by the only reflector in the reflector system, or by the main or final reflector in a multi-reflector system, the position of the effective reflecting surface of such a matching log-periodic reflector will vary directly with that of the phase center of the feed system to produce compensation for movement of this phase center. Alternatively, where the frequency dependent reflector is provided by a single intermediate sub-reflector, the axial spacings of the reflector elements in a matched log-periodic reflector, in the direction of incidence, will be reduced by a factor of two to produce only half the variation in the position of the effective reflecting surface, because of its two-way effect on path length.

Alternatively, the mesh reflector elements may comprise resonant reflector elements consisting of a conductive mesh, grid or pattern containing both inductive and capacitive components which interact to determine the resonant frequency thereof, at which reflection of incident radiation occurs.

The frequency selective reflecting elements may be self-supporting, ie sufficiently rigid to be supported by a suitable frame. Alternatively, the elements may be sandwiched between low-loss dielectric spacers, eg of foam dielectric material, suitably contoured, and of suitable thickness to match the required axial spacings of the elements. Where the frequency dependent reflector is provided by a sub-reflector, the mesh reflector elements may be planar thereby easing manufacture. The elements may be held in their desired locations by pressure between adjacent dielectric spacers, or they may be bonded or deposited onto the spacers or thin spaced sheets before stacking. As an alternative to the above described form of frequency dependent reflector using reflector elements comprising resonant or inductive meshes, grids or patterns, the frequency dependent reflector may comprise a suitably contoured or planar array of substantially identical horn or wedge reflectors, the longitudinal cross-section of each of which corresponds substantially to the envelope of the feed system. Thus the effective surface of reflection of the horn or wedge array will move backwards towards the throats of the horns or wedges with increasing frequency. In the case of a frequency dependent sub-reflector, the lengths of the horns or wedges will be substantially halved due to the two-way effect on path length as explained above.

Another method of achieving the desired movement of the focus of the reflector system with frequency, is to use a frequency dependent reflector whose focal length varies with frequency in such a way as to cause the focus of the reflector system to follow variations in the position of the phase center of the feed system with frequency. This may be achieved in accordance with the invention by the use of a frequency dependent reflector in which the curvature of the effective surface of reflection varies with frequency; in the case of a single reflector system, or a multi-reflector system in which the frequency dependent reflector is provided by the main or final reflector, to match changes in the position of the phase center of the feed system; and in the case of a frequency dependent sub-reflector, to maintain an unchanged distance between the virtual image of the phase center of the feed system produced by the sub-reflector, and the main or final reflector.

The frequency dependent reflector may then comprise a plurality of conducting frequency selective reflecting elements of different curvatures, disposed in order of reducing mesh pitch away from the feed system. In the case of a concave frequency dependent reflector, the curvature of the reflector elements will increase with reducing pitch while in the case of a convex frequency dependent reflector, the curvature will reduce with reducing pitch.

As appropriate, the same techniques regarding the construction of the conducting mesh, grid or pattern reflector elements, described above, may be adapted to the construction of the present variable focal length mesh sub-reflector. As an alternative to using an array of mesh reflecting elements, the variable focal length frequency-dependent reflector may comprise a suitably curved array of reflecting horns or wedges, the lengths of the horns or wedges varying appropriately with their radial distance from the axis of the reflector, but each horn or wedge covering the same operating frequency range. In a simplified form of reflector antenna in accordance with the present invention, the frequency dependent reflector may simply comprise a single frequency selective reflector element spaced in front of a suitably contoured (or planar where appropriate) continuous reflecting surface, the frequency selective reflector element being so adapted, and positioned relative to the feed system, and the continuous reflecting surface, to produce an effective reflecting surface for focusing incident waves at or near the minimum operating frequency of the antenna, while the continuous reflecting surface is positioned relative to the feed system to produce an effective reflecting surface for focussing incident radiation at or near the maximum operating frequency of the antenna, the arrangement being such that at intermediate frequencies, the position of the effective reflecting surface of of frequency dependent reflector varies substantially with the position of the phase center of the feed system to produce the desired compensation.

Preferably the frequency selective reflector element is a resonant reflector element having a resonant frequency equal to the minimum frequency of operation of the antenna, and is positioned relative to the feed system to reflect and focus incident radiation at this frequency, while the continuous reflecting surface is preferably positioned behind the frequency selective reflector element at a distance related to the distance between the phase centers of the feed system at the maximum and minimum operating frequencies. Where the two reflector elements are parallel, the separation between them will thus be equal to the separation of the phase centers of the feed system at the minimum and maximum operating frequencies, in applications in which the frequency dependent reflector is the only or final reflector in the antenna systems, while it will be reduced by a factor of two in applications in which it provides a sub-reflector in a multi-reflector antenna as discussed earlier.

The frequency selective reflector may alternatively comprise an inductive reflector element, in which case its actual position relative to the feed system will not correspond exactly to the effective surface of reflection of the reflector at which incident radiation at the minimum operating frequency of the antenna is reflected, because inductive reflector elements cannot be made fully reflecting at above zero frequencies. In practice, the effective reflecting surface for radiation at this minimum frequency will appear a short distance behind the inductive reflector element relative to the feed system. The two reflector elements in such simplified frequency dependent reflectors may be parallel to one another, such that the effective reflecting surfaces produced for different frequencies within the operating frequency range of the antenna are substantially parallel. Alternatively, the two reflector elements may be of different curvatures, so that the curvature of the effective reflecting surface thereof varies with frequency whereby to compensate for frequency variations in the position of the phase center of the feed system by varying the focal length of the reflector. The continuous reflecting surface may alternatively comprise a frequency selective reflector element capable of reflecting radiation at all frequencies between the minimum and maximum operating frequencies of the antenna.

The invention will now be further described by way of example only, with reference to the accompanying drawings, of which:

Figure 1:
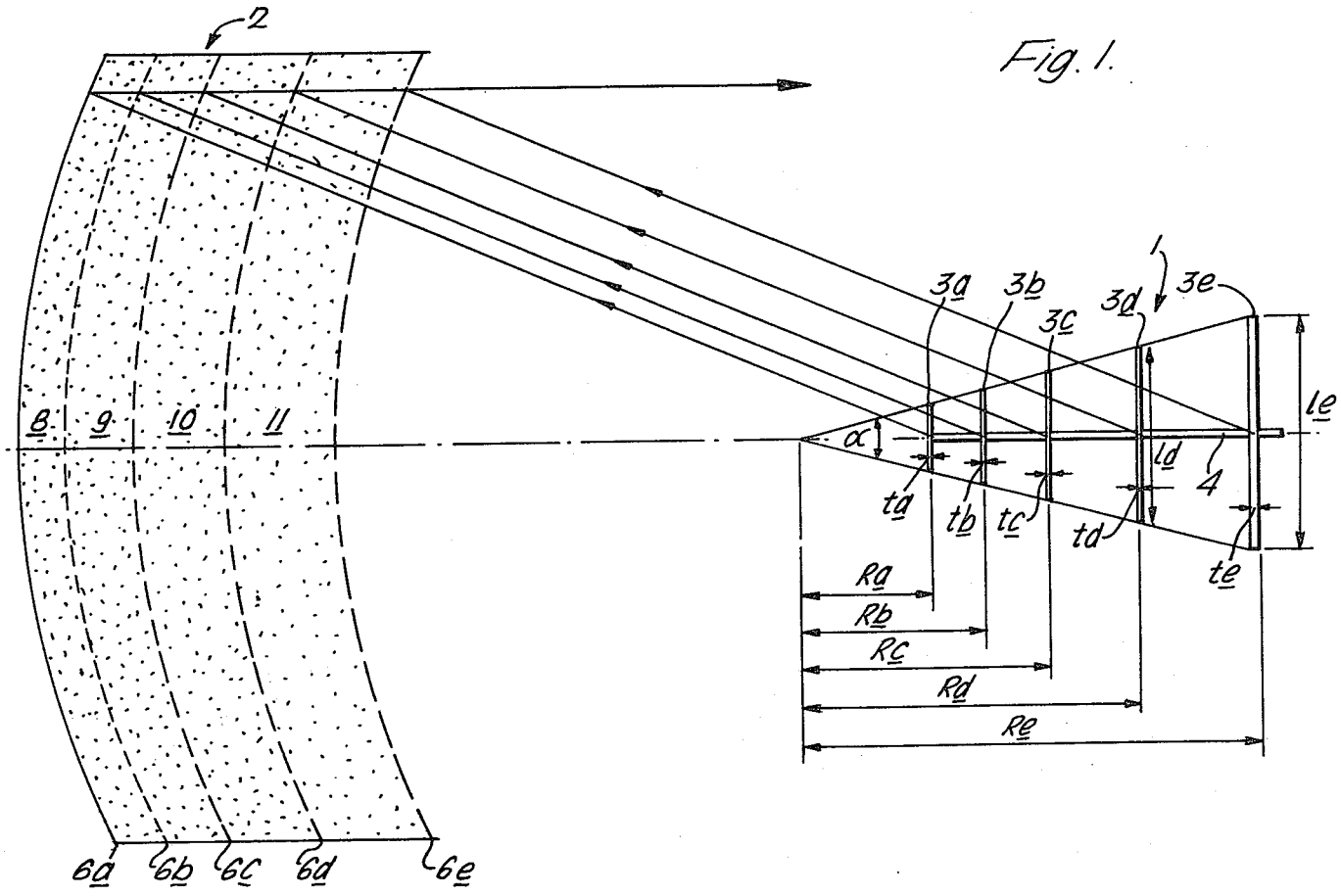
FIG. 1 is a schematic representation of one reflector antenna in accordance with the present invention.

Referring to the drawings, the reflector antenna shown schematically in FIG. 1 comprises a log-periodic feed 1 of any suitable known form and a frequency dependent collimating (eg parabolic) reflector 2. The log-periodic feed is represented for the sake of convenience as an array of dipole elements 3*a* to 3*e* of varying lengths 1*a* to 1*e* respectively, spaced apart along an axial feeder 4 to form a triangular pattern subtending an angle $\alpha$ at its apex. The respective elements 3*a* to 3*e* are spaced from the apex of the triangle at distances of Ra to Re in order of increasing length, in accordance with the following relationship.

$$\frac{1a}{1b} = \frac{1b}{1c} = \frac{1c}{1d} = \frac{1d}{1e} = \frac{Ra}{Rb} = \frac{Rb}{Rc} = \frac{Rc}{Rd} = \frac{Rd}{Re} = \text{constant}$$

This provides the log-periodic structure in that the dipole elements are spaced apart periodically as the logarithm of their resonant frequency, this being proportional to the length of the element as is well known. The phase center of the log-periodic feed will thus move along the axis of the feed linearly with wavelength.

Another factor in the design of the feed structure is the thicknesses or diameters ta to te of the elements which affects the intensity of energy radiated from them. Desirably, to produce a substantially uniform response characteristic over the operating frequency range, the length-to-diameter ratio (l/t) is the same for all the dipole elements.

Figure 2:
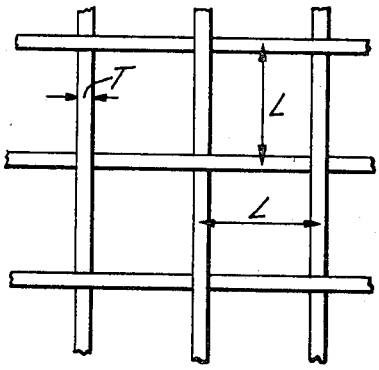
FIG. 2 is a detail, on an enlarged scale, of part of the reflector antenna of FIG. 1.

By analogy to the log-periodic structure of the feed 1, the frequency dependent reflector 2 also has, in accordance with the present invention, a log-periodic structure comprising a plurality of woven wire mesh inductive reflector elements 6*a* to 6*e* of different mesh pitches, each mesh element corresponding to a respective one of the dipole elements 3*a* to 3*e* of the log-periodic feed 1. The relevant parameters of each mesh element are illustrated in FIG. 2, where L is the spacing between the wires of the mesh, ie the mesh pitch, corresponding to the length l of the corresponding dipole element, and T is the diameter of the wire, ie the mesh gauge, corresponding to the diameter t of the associated dipole element.

It can be shown that the approximate voltage reflection and transmission coefficients of such an inductive mesh reflector for normal incidence are respectively:

$$-1/[(1 + 2jL/\lambda) \cdot \log_e(L/\pi T)]$$

-continued and $$1 - j/[(2L/\lambda) \cdot \log_e(L/\pi T)]$$

where $\lambda$ is the wavelength.

Thus if the ratios L/$\lambda$ and L/T are made constant for each mesh, then the proportion of energy reflected and transmitted is constant at the particular wavelength $\lambda$ associated with each mesh element. This is analogous to the log-periodic feed elements where the element length l is proportional to its resonant wavelength, and the element length-to-diameter ratio is constant so that the proportion of energy radiated (or received) per element is constant at the respective frequencies.

Thus, by choosing the appropriate L/$\lambda$ and L/T ratios for the meshes 6*a* to 6*e* to match the characteristics of the respective feed elements 3*a* to 3*e* of the feed 1, and spacing the mesh elements of the reflector in the same spatial relationship with respect to the corresponding feed elements, the effective surface of reflection of the reflector (corresponding by analogy to the phase center of the feed) will maintain substantially the same spatial relationship with respect to the phase center of the feed over the operating frequency range. Thus the position of the focus of the reflector 1, can be made to substantially follow movements of the phase center of the feed system over the operating frequency range.

As shown the wire mesh elements are supported in their spaced-apart relationship by low-loss foam dielectric (eg expanded polystyrene) spacers 8,9,10,11 the parallel surfaces of which are appropriately contoured to the required curvature of the mesh reflector elements 6*a* to 6*e*, and their thicknesses corresponding to the desired axial spacing between the adjacent elements which they separate. The front and rear elements 6*e*, 6*a* respectively are bonded to the outwardly facing surfaces of the spacers 11 and 8, and the intermediate elements 6*b* to 6*d* sandwiched between the spacers which are bonded together using a suitable adhesive. The mesh elements may alternatively comprise conductive metallic patterns formed on the appropriate surfaces of the spacers, or on self-supporting insulating substrates eg of MYLAR (Registered Trade Mark) for example by evaporation and etching. Alternatively, the mesh elements may be sufficiently rigid so as to be self-supporting within a framework structure. The rearmost element may comprise a continuous conducting surface, for example in the form of a conventional dish reflector.

Furthermore, the reflector need not have a separate mesh reflector corresponding to each element of the feed; elements corresponding to every second or third etc element of the feed may be sufficient.

The spacings and transmission-reflection characteristics, of the meshes, need not correspond to those of respective feed elements. Any suitable configuration may be adopted which produces a movement of the effective reflecting surface substantially equal to that of the phase center of the feed 1.

Figure 3:
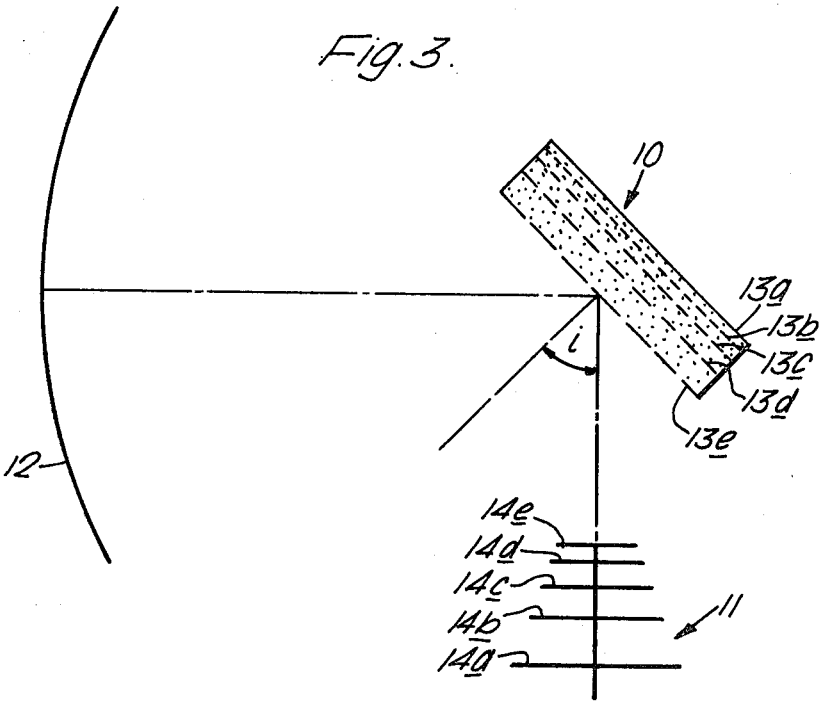
FIG. 3 is a schematic representation of a second reflector antenna in accordance with the present invention.

For single-polarization log periodic feeds comprising a single planar array of dipole elements (as shown for convenience in FIG. 1) the mesh reflector elements may each simply comprise an array of parallel conducting wires or strips aligned parallel with the plane containing the dipole elements of the feed (parallel strips or wires will not reflect radiation polarized in an orientation perpendicular to the conducting strips). Correspondingly, where the mesh reflector elements do comprise perpendicularly crossed sets of parallel conducting strips, as shown in FIG. 2, then the feed system may comprise a single-polarization feed having a planar array of dipoles aligned with one or other of the sets of mesh strips, or, more usually it will comprise a dual-polarization feed having two perpendicularly crossed planar arrays of dipole elements. In some forms of dual polarization feeds, the dipoles of one of the arrays (X-dipoles) are disposed at axial positions between those of the other array (Y-dipoles), but both usually fitting within the same triangular or exponential "envelope" or profile. For this type of feed, each of the reflector elements may then comprise a single set of parallel wires or strips, the strips of alternate reflector elements then being aligned with alternate ones of the spaced dipole elements of the feed with which they correspond. FIG. 3 shows a second form of reflector antenna in accordance with the invention in which the reflector system comprises a frequency dependent planar sub-reflector 10 arranged to reflect radiation between a log-periodic feed 11 and a main collimating reflector 12, through an angle of 90°. The main reflector 12 comprises a continuous conducting dish reflector of conventional form, while the frequency dependent reflector 10 again comprises a plurality of mesh reflectors 13*a* to 13*e* each one corresponding to, and being matched with, a respective one of the log-periodic feed elements 14*a* to 14*e* using the same considerations described above.

However, for the movement of the focus of the reflector system to follow movements of the feed phase center, the spacing between the mesh elements 13*a* to 13*e* of the planar sub-reflector 10, in the direction of incidence of radiation from the feed 11, must be half that of the corresponding elements of the feed, because of the two-way effect on path length. Thus, for a matched reflector, the actual spacing between the adjacent mesh elements is shorter by a factor of $\frac{1}{2}$ cosi where i is the angle of incidence with respect to the normal (ie 45° in this case), relative to the spacing between corresponding adjacent elements of the feed.

Because, in such arrangements, the local angle of incidence can vary significantly over the surface of the sub-reflector, it is desirable to ensure that the projected spacing between the wires or strips of each mesh reflector, orthogonal to the incident wave, is maintained substantially constant over the surface of the reflector. This may be achieved by locally varying the actual spacing of the wire or strips of each element in dependence upon the angle of incidence of waves reflected from them. The frequency dependent sub-reflector may be constructed in the same manner as that described for the frequency dependent reflector of FIG. 1. However, due to the planar form of the sub-reflector, manufacturing problems are considerably reduced and the sub-reflector can be made considerably smaller, although it will be appreciated that a non-planar sub-reflector may alternatively be used.

Although the embodiments described above employ mesh reflectors comprising perpendicularly crossed sets of parallel inductive strips, other forms of frequency dependent reflector element may alternatively be used. For example each of the reflector elements may be replaced by self-resonant reflectors, the reflection frequencies of which are determined by their resonant frequency. Suitable forms of such self-resonant structures are described in J. A. Arnaud and P. A. Pelow, 'Resonant Grid Quasi Optical Diplexers', Bell Systems Technical Journal, Vol 54, No. 2 (February 1975) pp 263 to 268, and in I. Anderson, 'On the Theory of Self-Resonant Grids', Bell Systems Technical Journal, Vol 54, No. 10 (December 1975) pp 1725 to 1731. These papers describe respectively an experimental and a theoretical study of the transmission, reflection and depolarization of metal grids that reflect an upper band of radio frequency waves centered at 30 GHz and transmit a lower band centered at 20 GHz. The metal grid structures are of types known as "Jerusalem" crosses; these structures are further described in the present specification and an example as shown in FIG. 5.

Figure 4:
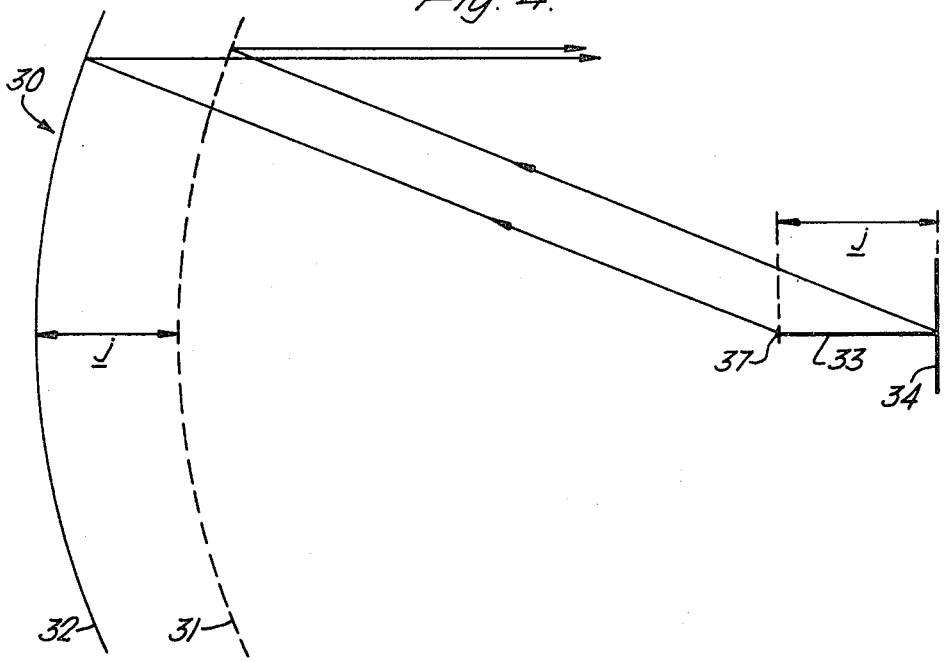
FIG. 4 is a schematic representation of a third reflector antenna in accordance with the present invention.
Figure 5:
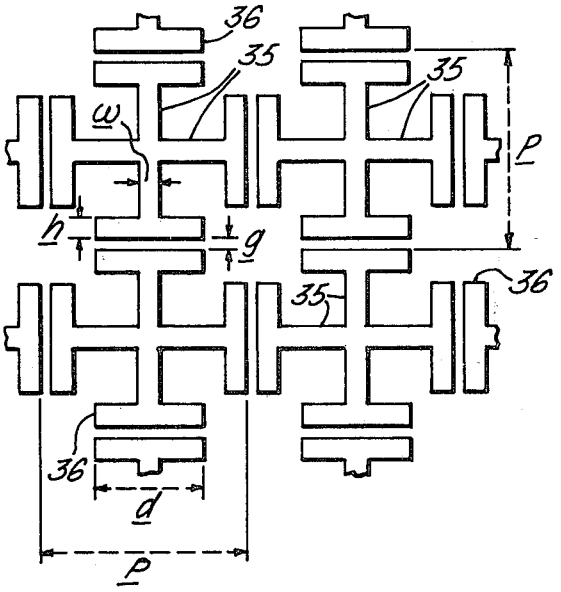
FIG. 5 is a detail, on an enlarged scale, of part of the antenna of FIG. 4.

FIGS. 4 and 5 show a further simplified form of reflector antenna in accordance with the present invention.

The reflector antenna shown in FIG. 4 is similar to that shown in FIG. 1, and comprises a spherical (or parabolic) reflector 30 consisting of only two reflecting elements 31,32 fed by a log-periodic feed 33.

The rear element 32 comprises as before, a continuous conductive metal surface while the front reflector element 31 is a self-resonant reflector grid comprising a metallic pattern, a small section of which is shown on an enlarged scale in FIG. 5, formed by standard photolithographic techniques on an insulating substrate, eg MYLAR (Registered Trade Mark). This pattern may be regarded as two perpendicularly crossed sets of parallel inductive strips 35, with periodically inserted series capacitive elements 36, thus producing in appearance, a periodic array of 'Jerusalem' crosses. Such an array resonates at a frequency determined by the series inductances and capacitances of the pattern as discussed in detail in the aforementioned papers.

As shown, the period of the pattern is p, the width of the inductive strips 35 is w, and the separation of the capacitive elements 36 is g. The length and width of the capacitive elements 36 are d and h respectively, and the thickness of the metal pattern is t. The parameters of the pattern are selected such that:

$$t << w << p;\ h << p < \lambda;\ g << d << \lambda$$

where λ is the frequency of resonance. It can be shown that the wavelength of the resonant frequency of the reflector grid 31 is given approximately by:

$$\lambda \approx 2\sqrt{dp \ln(2p/\pi w) \ln(2p/\pi g)}$$

In designing a reflector antenna of the kind shown in FIG. 4, the resonant frequency of the front grid reflector element 31 at which it is substantially 100% reflective, is chosen to equal the minimum operating frequency $f_1$ of the log periodic feed 33 produced by the largest dipole element 34. The rear reflector element 32 is spaced apart from the reflector element 31 by a distance equal to the spacing between the lowest frequency dipole element 34 of the feed 33 and the highest frequency dipole element 37, resonant at a frequency $f_2$ at which the front grid reflector is substantially transparent.

Thus variations in the position of the phase center of the feed system 33 are compensated at both the minimum and maximum operating frequencies, and it has been found that the position of the effective surface of reflection of the reflector 30 varies between the front and rear reflector elements 31, 32 in a manner substantially corresponding to the variation in the position of the phase center of the feed, so that substantial compensation is also achieved at these intermediate frequencies. However, the closeness of correspondence in the positional variations of the phase center of the feed and the effective reflecting surface of the reflector will depend inter alia, on the variations in the transmissivity of the grid reflector element 31 with frequency at these intermediate frequencies. By way of example, the parameters of the antenna system may be selected as follows. For the log-periodic feed 33: $f_1=4.0$ GHz, $f_2=12$ GHz; distance j between phase-centers at maximum and minimum frequency=23 mm. For the grid reflector element 31: p=15 mm, g=0.5 mm, d=10 mm, w=h=1.0 mm, t=0.018 mm. The spacing between the two reflectors elements 31, 32 is set equal to the distance j between the phase centers of the feed 33 at frequencies $f_1$ and $f_2$, ie at 23 mm, and the distance between the grid reflector element 31 and the phase center of the feed at frequency $f_1$ is equal to the focal length of the reflector element 31.

It will be appreciated that, as before, for a single polarization log-periodic feed, comprising a planar array of dipoles, the metallic pattern of the reflector grid 31 need only contain one set of parallel inductive strips with periodically inserted capacitive elements 36, the strips 35 being aligned parallel to the plane containing the feed dipoles. Correspondingly, were two sets of perpendicularly crossed parallel strips 35 (with capacitive elements 36) are used, as in the pattern shown in FIG. 5, the feed will normally comprise a dual polarization system having two planar sets of perpendicularly crossed dipoles.

The self-resonant grid element 31 of the FIG. 4 embodiment may be replaced by an inductive reflector element, for example of the type used in the embodiments of FIGS. 1 to 3. However, because such inductive elements cannot be made fully reflecting at above zero frequencies, the mesh reflector must be spaced an appropriate distance in front of the normal position that a self-resonant reflector element would occupy, in order to produce an effective surface of reflection at this position at the frequency $f_1$.

The reflector system of the type described with reference to FIGS. 4 and 5 may also be used to replace the frequency dependent sub-reflector 10 in antennas of the kind shown in FIG. 3. However, as described in connection with FIG. 3, the separation of the two reflector elements 31, 32 of such a sub-reflector will be half that of the corresponding minimum and maximum frequency dipoles of the feed, due to the two-way effect on path length, subject to a correction factor for non-normal angles of incidence. Again, a non-planar sub-reflector may be used when required.

Figure 6:
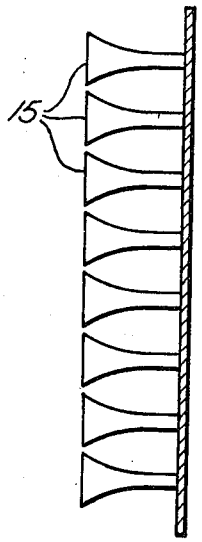
FIG. 6 is a schematic representation of an alternative form of frequency dependent reflector in accordance with the present invention.

The frequency dependent reflectors of the FIGS. 1 and 4 embodiments, or the planar frequency dependent sub-reflector 10 of FIG. 3, may be replaced by an alternative form of frequency dependent reflector comprising a suitably contoured, or planar array of reflecting cones, wedges or horns as shown by way of example in FIG. 6.

FIG. 6 shows a planar array of exponential horn reflectors 15, which array may be used to replace the planar sub-reflector of the FIG. 3 antenna. The FIG. 1 frequency dependent reflector will of course require a suitably contoured array of horn reflectors of the same curvature to replace it. Each horn 15 of the array is identical, and as shown, has an exponential longitudinal cross-section which matches the log-periodic frequency characteristic of a log-periodic feed. The effective point of reflection of each reflector horn 15, which may conveniently be of circular, square or hexagonal cross-section, at any given frequency is determined by the transverse cross sectional area of the horn, the lower frequencies being reflected at the wider cross-sectionsl areas towards the mouth of the horn, the effective point of reflection moving back towards the throat of the horn with increasing frequency. Thus, the effective surface of reflection of the horn reflector array moves backward with increasing frequency in dependence upon their exponential longitudinal cross-section, and can be made to compensate for variations in the feed phase center movement by appropriate choice of its design parameters.

The exponential horns 15 may be replaced by hollow conducting cones or wedges, ie having a linearly varying cross-section profile, particularly where the 'envelope' of the log periodic feed has a corresponding profile. Whatever the profile of the reflector horns, the half-angle thereof should not exceed 18° for normally incident waves, and 15° for other than normal incidence, assuming this to be within the confines of the horn itself, to ensure that they behave as a quasi wave guide rather than a corner reflector.

As an alternative to using a frequency dependent reflector in which the effective reflecting surface moves axially with frequency to provide the required compensating movement of the focus of the reflector system, the focal length of the frequency dependent reflector may be made to vary with frequency to achieve substantially the same desired result.

Figure 7:
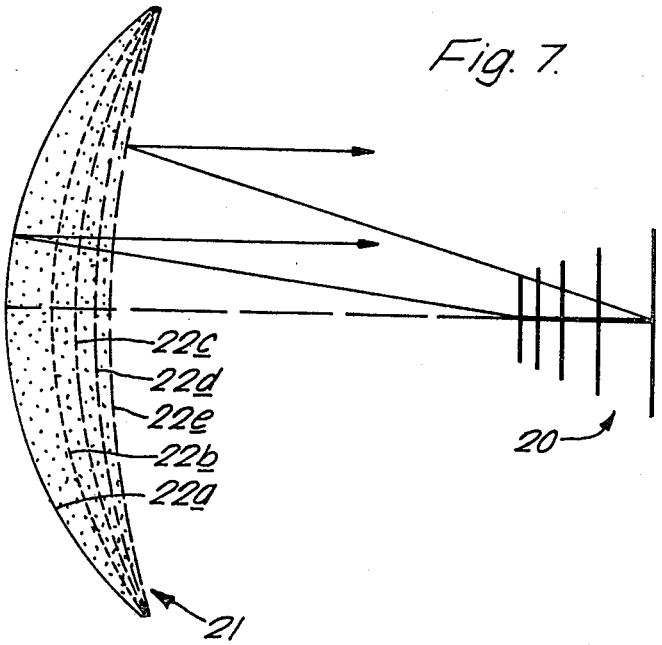
FIG. 7 is a schematic representation of a yet further form of antenna in accordance with the present invention.

A reflector antenna incorporating such a frequency dependent reflector is shown schematically in FIG. 7. The general arrangement is similar to that of FIG. 1, comprising a log-periodic feed 20 and a single frequency dependent collimating reflector 21 made up of a plurality of mesh reflector elements **22*a* to 22*e* using the same construction techniques as described with reference to FIG. 1. However, the present frequency dependent reflector differs from that of the FIG. 1 antenna in that the mesh reflector elements are no longer parallel, but are of different curvatures, the curvature increasing with reducing mesh pitch in a direction away from the feed 20. The frequency dependent reflection/transmission characteristics of each of the mesh elements 22*a* to 22*e* are again matched to respective ones of the feed elements so that, to a first approximation, energy radiated by the longest, low frequency feed element is reflected by the frontmost open mesh reflector element 22*e*** and so on, the focal points of the respective mesh elements coinciding approximately with the spatial position of the corresponding feed elements. In this way, the curvature of the effective reflecting surface of the frequency dependent reflector can be made to vary with frequency in such a way as to produce a focus which follows the movement of the phase center of the feed.

In determining the curvatures of the respective mesh reflector elements, account must also be taken of their different axial positions.

As before, the frequency dependent mesh reflector arrangement may be replaced either by a reflector having only two reflector elements or by an array of horn reflectors of different dimensions directed towards the feed. In the first alternative, the positions of the two reflector elements will substantially correspond to the positions of the front and rear reflector elements **22*e*, 22*a*** respectively, while in the latter alternative, the narrow ends of the horns (or wedges) will follow the contour of the rearmost, high frequency reflecting elements of the corresponding mesh reflector arrangement, and the mouths of the horns will follow the contour of the most open mesh reflector element. Each of the horn reflectors will have the same transverse cross-sectional area at its mouth matching the pitch of the most open mesh reflector, and as its throat matching the pitch of the finest mesh reflector, but the lengths of each horn will vary appropriately with its separation from the axial center of the array. In this way, the effective surface of reflection of the array will vary in curvature with frequency to cause the focus of the reflector to vary with the position of the feed phase center.

The effective position of the outer annular region of the frequency dependent mesh reflector 21 may be advanced towards the feed, thereby increasing its curvature, by mounting on its surface suitable log-periodic feed structures pointing towards the feed.

While the invention has been described with respect to the details of various illustrative embodiments, many modifications apparent to those skilled in the art can be made without departing from the scope of the invention. For example, any departures from the ideal in the log-periodic feed, such as may occur for example as a result of using a feed having a non-linear frequency characteristic over its operative bandwidth, may be compensated for by appropriate design of the frequency dependent reflector. Convex frequency-dependent reflectors may be used where antennae design requires them. The invention may be applied to antennae having more than one sub-reflector, and in such cases, the required movement of the focus of the antenna reflector system may be achieved by multiple reflections between a pair of sub-reflectors, at least one of which is frequency-dependent. The thickness or depth of each frequency dependent sub-reflector can thus be made relatively small by mutiplying its two-way effect on path length in this way. Furthermore, the invention may also be used to compensate for frequency variations in the position of the phase-center of other than log-periodic feed systems, for example corrugated horn feed systems.

What we claim is:

1. A reflector antenna adapted to avoid defocussing with frequency of an antenna beam being emitted or received by the antenna, said antenna comprising a reflector system, a broadband feed system for illuminating said reflector system to produce a focussed antenna beam, said feed system being operative over a continuous frequency band with the phase center of said feed system moving along an axis towards the reflector system as the frequency increases, the reflector system comprising a structure having a plurality of parts which are dimensioned respectively in relation to the different wavelengths in said frequency band of said feed system to provide a plurality of effective surfaces of reflection that are located at different depths within said structure which depths increase respectively with increasing frequency over said frequency band, whereby radiation in a given frequency region of said band is reflected at an effective surface of reflection located at a given depth within said structure while radiation of higher frequency penetrates beyond it, said structure being dimensioned depthwise in relation to the axial movement of the phase center of said feed system so that changes in the axial position of the phase center of said feed system are matched by changes in the depth of the effective surface of reflection in said structure thereby to maintain the position of the focus of the reflector system substantially coincident with the position of the phase center of said feed system as the frequency changes over said frequency band.

2. A reflector antenna as claimed in claim 1, wherein said effective surfaces of reflection are parallel.

3. A reflector antenna as claimed in claim 1, wherein the curvature of the effective surface of reflection varies with frequency whereby to vary the focal length thereof.

4. A reflector antenna as claimed in claim 1, wherein the feed system is a log-periodic feed system.

5. A reflector antenna as claimed in claim 1, 2, 3 or 4, wherein said structure comprises a plurality of frequency selective reflector elements each adapted to reflect incident radiation within a predetermined frequency range, and to transmit incident radiation above its predetermined frequency range, the predetermined frequency range being different for different ones of the elements, and the reflector elements being spaced apart from the feed system along the incident beam path in order of increasing frequencies of reflection.

6. A reflector antenna as claimed in claim 5, wherein each frequency selective reflector element comprises an inductive metallic grid, mesh or pattern.

7. A reflector antenna as claimed in claim 5, including a continuous conductive reflector element disposed behind said frequency selective reflector elements.

8. A reflector antenna as claimed in claim 5, wherein each frequency selective reflector element comprises a resonant metallic grid, mesh or pattern containing capacitive and inductive components, the predetermined frequency range of reflection being determined by the resonant frequency thereof.

9. A reflector antenna as claimed in claim 6, including a continuous conductive reflector element disposed behind said frequency selective reflector elements.

10. A reflector antenna as claimed in claim 1, 2, 3 or 4, wherein said structure comprises two reflector elements consisting of a first frequency selective reflector element, the transmissivity of which increases with frequency over the frequency range of operation of the feed system, and a second reflector element positioned behind the first reflector element and capable of reflecting substantially all incident radiation over the frequency range of operation of the feed system.

11. A reflector antenna as claimed in claim 10, wherein the first reflector element is a resonant metallic grid, mesh or pattern containing inductive and capacitive elements, and the second reflector element is a continuous conductive surface.

12. A reflector antenna as claimed in claim 11, wherein the first reflector element is resonant at the minimum operating frequency of the feed system and is positioned to reflect and focus substantially all incident radiation from the feed system at this frequency, and the second reflector element is positioned to reflect and focus substantially all incident radiation from the feed system at the maximum operating frequency thereof, the arrangement being such that the effective surface of reflection of the reflector varies between the positions of the two reflector elements at frequencies intermediate the minimum and maximum operating frequencies of the feed system.

13. A reflector antenna as claimed in claim 10, wherein the first frequency selective reflector element is an inductive metallic mesh, grid or pattern, and the second reflector element is a continuous conducting sheet.

14. A reflector antenna as claimed in claim 1,2,3 or 4, wherein said structure comprises an array of conductive reflecting horns, hollow wedges or hollow cones the mouths of which are directed to receive incident radiation from the and feed system, the longitudinal cross-section of each of which corresponds substantially to the envelope of the feed system.

15. A reflector antenna as claimed in claim 1,2,3 or 4, wherein said structure comprises the only or final reflector in the reflector system, and the rate of movement with frequency of the effective surface of reflection thereof varies directly with that of the phase-center of the feed system.

16. A reflector antenna as claimed in claim 1,2,3 or 4, wherein said structure comprises an intermediate sub-reflector arranged between the feed system and a final reflector of the antenna, and the rate of movement with frequency of the effective surface of reflection thereof is substantially half that of the phase-center of the feed system.

* * * * *